United States Patent [19]

Heikkinen

[11] Patent Number: 5,076,398

[45] Date of Patent: Dec. 31, 1991

[54] ROPE SUSPENSION SYSTEM FOR AN ELEVATOR

[75] Inventor: Urho Heikkinen, Espoo, Finland

[73] Assignee: Kone Elevator GmbH, Baar, Switzerland

[21] Appl. No.: 602,896

[22] Filed: Oct. 24, 1990

Related U.S. Application Data

[63] Continuation of Ser. No. 321,240, Mar. 9, 1989, abandoned.

[30] Foreign Application Priority Data

Mar. 9, 1989 [FI] Finland ..... 881099

[51] Int. Cl.[5] ..... B66B 11/04

[52] U.S. Cl. ..... 187/20; 254/400

[58] Field of Search ..... 187/20, 22, 27, 94; 254/400, 264, 371

[56] References Cited

U.S. PATENT DOCUMENTS 4,030,569 6/1977 Berkovitz ..... 187/20
4,591,025 5/1986 Honda ..... 187/20
4,807,723 2/1989 Salmon et al. ..... 187/20

FOREIGN PATENT DOCUMENTS 2190891 12/1987 United Kingdom ..... 187/22

*Primary Examiner*—Robert P. Olszewski
*Assistant Examiner*—Kenneth Noland
*Attorney, Agent, or Firm*—Sughrue, Mion, Zinn, Macpeak and Seas

[57] ABSTRACT

A rope suspension apparatus for an elevator system, includes a bed, a motor 1 attached to the bed, a motor shaft 2, a traction sheave 4 so mounted on the shaft that the ends of the traction sheave are inclined at an angle relative to vertical, and at least one diverter pulley 5, such that at least one suspension rope 11 may run from an elevator car to the traction sheave via a route between the traction sheave and the diverter pulley. The arrangement provides that each suspension rope may, after passing around the traction sheave, 1 run to the respective one of the at least one the diverter pulley via a route proximal to that of the suspension rope going towards the traction sheave, and at least one counterweight may be suspended on the suspension rope below the diverter pulley wherein the traction sheave has been rotated substantially sideways by an angle substantially equal to the angle that the ends of the traction sheave are inclined relative to vertical.

7 Claims, 2 Drawing Sheets

FIG. 3
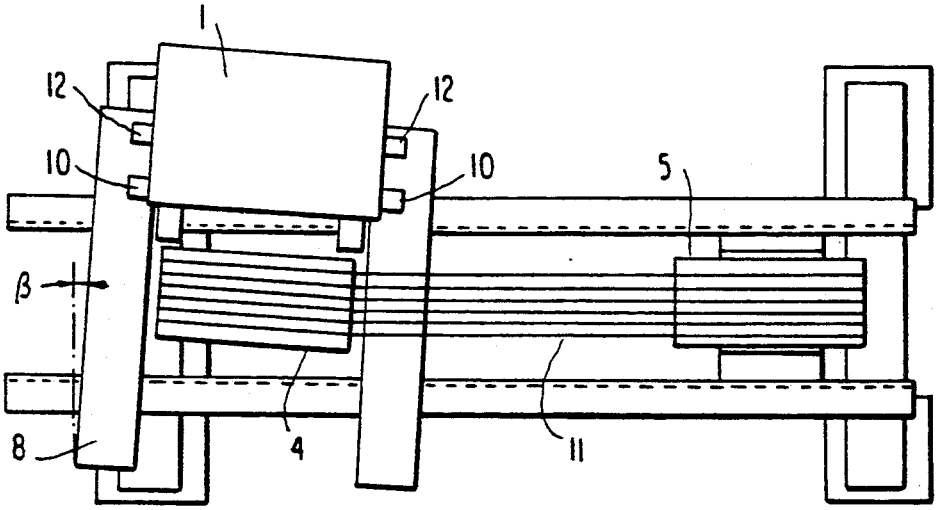
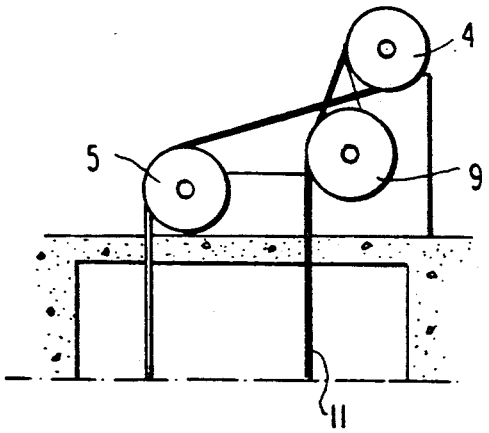
FIG. 4
PRIOR ART
FIG. 5
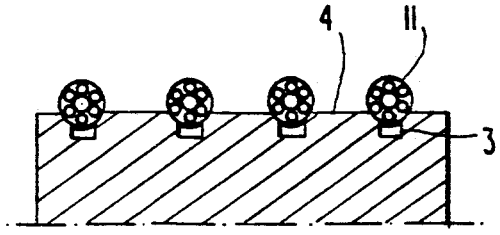

ROPE SUSPENSION SYSTEM FOR AN ELEVATOR

This is a continuation of application Ser. No. 07/321,240, filed Mar. 9, 1989, now abandoned.

BACKGROUND OF THE INVENTION

1. Field of the Invention

The present invention relates to rope suspension system for an elevator.

2. Description Of Related Art

Elevators generally include a bed, a motor attached to the bed, a motor shaft, a traction sheave so mounted on the shaft that its plane of rotation is inclined relative to the vertical plane, and at least one diverter pulley. Generally, the suspension ropes in such suspension systems for elevators run from the elevator car to the traction sheave via a route between the traction sheave and the diverter pulley, so that the ropes after passing around the traction sheave run to the diverter pulley via a route proximal to that of the ropes extending towards the traction sheave, the counterweight being suspended on the ropes coming from the diverter pulley.

In current practice, gearless elevators operated at high speeds, such as 2.5 to 10 m/s, use traction sheaves and diverter pulleys provided with rope grooves that have a semicircular cross-section. Such practice necessitates the use of a so-called "double-wrap" suspension, hereinafter referred to as DW suspension, in order to achieve sufficient friction between the ropes and the traction sheave. In DW suspensions, each rope is passed twice around the traction sheave, so that the total angle of contact between each rope and the traction sheave is about 310° to 330°. In fast DW elevators, the suspension ratio is 1:2, by which is meant the rope speed equals twice the car speed. In such elevator systems the ropes going downwards from the traction sheave and diverter pulley are not attached, respectively, to the elevator car and the counterweight but rather are attached to an external fixed structure near the top of the hoistway, the elevator car and the counterweight being suspended on the ropes by pulleys. The high rope speed results in increased noise and vibration in the car. To reduce the noise level, insulation arrangements and their attendant costs are required.

There are many other disadvantages associated with DW suspensions. In 1:2 DW suspensions, the rope has to undergo as many as twelve diversions, which together with the high rope speed causes wear of the ropes and fatigue fractures in the rope wires. In addition, the traction sheave is subjected to a heavy radial load resulting from the large number of rope loops around it, which naturally imposes certain restrictions regarding the choice of a motor. An associated result is the so-called DW effect, in which in certain conditions of wear of the rope grooves, a large force acting between the traction sheave and the diverting pulley and tending to bend the shaft of the traction sheave is developed within the suspension mechanism.

There are also rope suspension systems designed for use with light-weight geared elevators. An example is Finnish patent 56813, which discloses an elevator with a suspension system using at least one diverter pulley to guide the suspension ropes in such manner that the ropes going to the traction sheave cross the ropes leaving it, the angle of contact between the ropes and the traction sheave being within the range of 210° to 250° and the distance between the point of crossing of the ropes and the point of their contact with the traction sheave equalling 1.9 to 0.7 times the traction sheave diameter. The traction sheave is slightly inclined to enable the ropes to run clear of each other at the crossing point. However, the angle between the ropes and the traction sheave is a disadvantage, causing a sideways pull and therefore heavy wear of the ropes.

A similar rope suspension system is proposed in British patent publication 2,148,229, according to which the rope grooves are provided with polyurethane inserts. However, that solution has the disadvantage that the polyurethane wears out quickly due to the lateral pull and the heat generated.

An object of the present invention is to achieve a rope suspension system which reduces of the above-mentioned drawbacks while still preserving substantially the same friction between the ropes and the traction sheave, providing a longer rope life.

SUMMARY OF THE INVENTION

Accordingly, the present invention provides a rope suspension apparatus for an elevator system, including a bed, a motor attached to the bed, a motor shaft, a traction sheave so mounted on the motor shaft that the ends of the traction sheave are inclined at an angle relative to vertical ("angle of inclination"), and at least one diverter pulley, such that at least one suspension rope may run from an elevator car to the traction sheave via a route between the traction sheave and the at least one diverter pulley, so that each suspension rope may after passing around the traction sheave run to a respective one of said at least one diverter pulleys via a route proximal to that of the suspension rope or ropes going towards the traction sheave and at least one counterweight may be suspended on the suspension rope or ropes below the at least one diverter pulley, wherein the traction sheave may be rotated substantially sideways by an angle ("angle of sideways rotation") substantially equal to the angle that the ends of the traction sheave are inclined relative to vertical.

In a preferred embodiment of the invention the angle of inclination and the angle of sideways rotation of the traction sheave are each 1.2°.

In another preferred embodiment of the invention the angle of inclination and the angle of sideways rotation of the traction sheave are such that the suspension rope or suspension ropes may run from the traction sheave to the at least one diverter pulley in the direction of the plane of rotation of the respective diverter pulley.

In a further preferred embodiment of the invention the bed is substantially horizontal, the motor may be supported on front support means and on rear support means, each of the front support means and the rear support means having support surfaces purposed to support the motor such that, when the motor is mounted on the bed, the motor shaft is inclined relative to horizontal and the ends of the traction sheave that is attached to the shaft are correspondingly inclined relative to vertical, and the bed and the supporter means permit the bed to be rotated substantially sideways before being fixed in place.

The invention provides several important advantages over previously known techniques. One of these advantages is the fact that the radial load imposed on the traction sheave is only half the corresponding load in fast elevators with DW suspension. The ropes only have to undergo four diversions, whereas in DW suspension the number of diversions is 12. Moreover, the invention permits the use of lighter cars and substantially smaller motors, involving, for example, a lower energy consumption. When a 1:2 suspension ratio is employed, the same motor is able to handle bigger loads as the radial loading of the sheave is diminished, and the number of rope diversions is reduced.

BRIEF DESCRIPTION OF THE DRAWINGS

Further objects, features and advantages of the invention will become apparent to those skilled in the art from the following description thereof when taken in conjunction with the accompanying drawings, in which:

FIG. 3 is a top plan view of the embodiment shown in FIG. 2;

FIG. 4 is a further embodiment of a prior art elevator;

FIG. 5 is a plan view of the suspension rope grooves, and suspension ropes on the traction sheave of an embodiment of the present invention.

DESCRIPTION OF THE PREFERRED EMBODIMENTS

Figure 1:
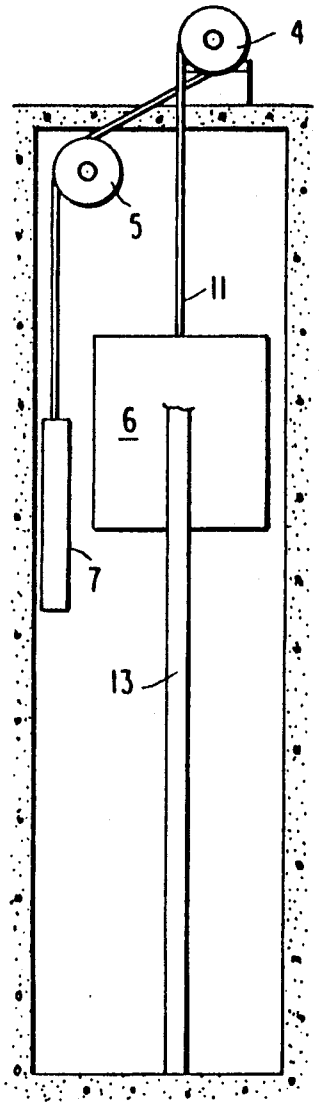
FIG. 1 PRIOR ART
FIG. 1 is a side view of a prior art elevator.

FIG. 1 shows an elevator with a rope suspension arrangement as provided by Finnish patent 56813, with the elevator car 6 mounted on guide rails 13 and lifted by means of suspension ropes 11. The suspension ropes 11, generally comprised of a number of ropes placed side by side, extend from the elevator car 6 to the traction sheave 4 and, after passing around the traction sheave 4, proceed further across the suspension ropes 11 between the elevator car 6 and the traction sheave 4 and then run over the diverter pulley 5 to the counterweight 7. With this crosswise arrangement of the suspension ropes 11, the angle of contact between the traction sheave 4 and the suspension ropes 11 is approximately 235°.

The configuration shown in FIG. 4 is known from Finnish patent 56813. In FIG. 4, the angle of contact between the suspension ropes 11 and the traction sheave 4 is the same as in FIG. 1, with the difference that an additional diverter pulley 9 is used to guide the suspension ropes 11 between the traction sheave 4 and the elevator car 6. In this way, the suspension ropes 11 coming from the traction sheave 4 can be accurately guided so that the suspension ropes 11 will pass each other at the crossing point at a very close distance between them but still without touching each other.

In the depiction of suspension ropes and suspension rope grooves shown in FIG. 5 are four suspension ropes 11 side by side and four suspension rope grooves 3 on the traction sheave 4. The number of suspension ropes 11 naturally varies with the need in each case. Unlike the rope grooves commonly used in DW suspensions, the suspension rope grooves 3 of the apparatus may have an undercut. A suitable undercut angle is about 50° to 90°.

As seen from the figures, the rope suspension apparatus may use a suspension ratio of 1:1, i.e. the suspension rope ends are directly attached to the elevator car 6 and the counterweight 7. The result is a lower suspension rope speed and consequently a reduced level of noise and vibration in the car 6. This also reduces the installation costs and permits a longer suspension rope life (given the fewer diversions than with DW suspensions). On the other hand, the 1:1 suspension ratio necessitates the use of steel core ropes. However, the invention is not restricted to systems with 1:1 suspension ratio but may also be applied to systems using 1:2 suspension.

Figure 2:
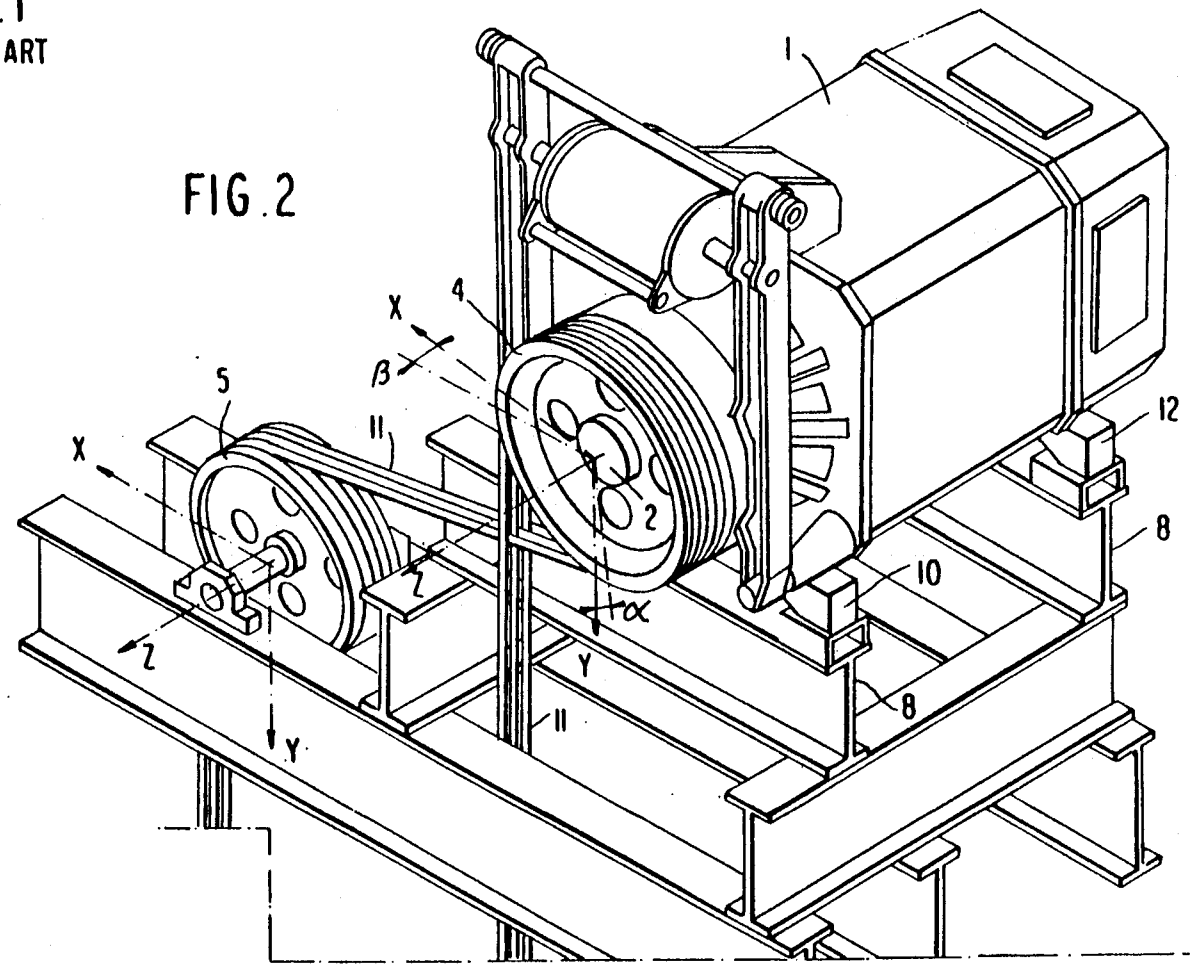
FIG. 2 is a perspective view of an embodiment of the invention.

Referring to FIGS. 2 and 3, in earlier rope suspension systems, the traction sheave 4 is only inclined relative to the vertical plane (y-axis) by the amount of given angle $\alpha$. In the present invention, the traction sheave 4 is also rotated sideways, for example, about the vertical line passing through its centre. In other words, the traction sheave 4 is placed at an angle $\beta$ relative to the x-axis as well. The angles $\alpha$ and $\beta$ are essentially equal. This angle of inclination and sideways rotation is preferably 1.2°, but other values between 0.7° to 1.7° may also be used. This arrangement, combined with a suitable choice of location of the traction sheave 4, makes it possible to achieve a system in which the respective suspension ropes 11 run from the traction sheave 4 to the diverter pulley 5 in the direction of the plane of rotation of the respective diverter pulley.

It will be obvious to a person skilled in the art that the invention is not restricted to the examples of its embodiments described above, but may instead be varied within the scope of the following claims without departing from the spirit or scope of the invention.

I claim:

1. A rope suspension apparatus for an elevator system, including a bed, a motor attached to said bed, a motor shaft, a traction sheave mounted on said motor shaft such that the rotational plane of said traction sheave is inclined at an angle $\alpha$ relative to vertical, a diverter pulley having a vertically oriented rotational plane, a suspension rope running from an elevator car to said traction sheave via a route between said traction sheave and said diverter pulley, said suspension rope, after passing around said traction sheave, running to said diverter pulley via a route proximal to that of said suspension rope going towards said traction sheave, and a counterweight suspended on said suspension rope below said diverter pulley, wherein said traction sheave is rotated sideways in a substantially horizontal plane by an angle $\beta$ substantially equal to said angle at which the rotational plane of said traction sheave is inclined relative to vertical.

2. A rope suspension apparatus according to claim 1, wherein said angle to which said rotational plane of said traction sheave is inclined relative to vertical and said angle by which said traction sheave has been rotated substantially sideways are each approximately 1.2°.

3. A rope suspension apparatus according to claim 1, wherein said angle at which said rotational plane of said traction sheave is inclined to vertical and said angle by which said traction sheave has been rotated sideways are such that said suspension rope runs from said traction sheave to said diverter pulley in a direction parallel to the plane of rotation of the diverter pulley.

4. A rope suspension apparatus according to claim 1, wherein said traction sheave bears at least one suspension rope groove corresponding to the number of said suspension ropes, each of said at least one suspension rope grooves being purposed to receive one of said suspension ropes.

5. A rope suspension apparatus according to claim 1, wherein said traction sheave bears at least one suspension rope groove corresponding to the number of said suspension ropes, each of said at least one suspension rope grooves being purposed to receive one of said suspension ropes provided with an undercut having an undercut angle in the range of 50° to 90°.

6. A rope suspension apparatus according to claim 1, wherein said bed is substantially horizontal, said motor is supported on front support means and on rear support means, each of said front support means and said rear support means having support surfaces purposed to support said motor such that when said motor is mounted on said bed, said motor shaft is inclined relative to horizontal and said rotational plane of said traction sheave that is attached to said shaft are correspondingly inclined relative to vertical, and said bed and said supporter means permit said motor to be rotated substantially sideways before being fixed in place.

7. An elevator suspension system including a support bed, a motor mounted to the bed, a traction sheave (4) mounted on a shaft of the motor, a diverter pulley (5) mounted to the bed at a position horizontally and vertically displaced from the traction sheave, and a suspension rope running from an elevator car up to a side of the traction sheave closest to the diverter pulley, around the traction sheave less than three-fourths of a turn, over the diverter pulley and down to a counterweight, characterized by:

a) the rotational plane of the traction sheave being tilted at a first angle $\alpha$ to vertical, and b) the rotational plane of the traction sheave being rotated substantially horizontally from a run of the suspension rope extending between the traction sheave and the diverter pulley by a second angle $\beta$ substantially equal to the first angle, c) such that said suspension rope run lies in a direction parallel to the rotational plane of the diverter pulley.

* * * * *